US006655899B1

(12) United States Patent
Emerson

(10) Patent No.: US 6,655,899 B1
(45) Date of Patent: Dec. 2, 2003

(54) MULTI-PURPOSE FRONT LOADER ATTACHMENT

(76) Inventor: Earl William Emerson, 526 SW. Bradshaw Cir., Port St. Lucie, FL (US) 34953

( * ) Notice: Subject to any disclaimer, the term of this patent is extended or adjusted under 35 U.S.C. 154(b) by 0 days.

(21) Appl. No.: 09/638,348

(22) Filed: Aug. 15, 2000

Related U.S. Application Data

(63) Continuation-in-part of application No. 09/039,751, filed on Mar. 16, 1998, now abandoned.

(51) Int. Cl.[7] ..... B66C 1/00
(52) U.S. Cl. ..... 414/729; 294/86.41; 294/3
(58) Field of Search ..... 414/729, 723, 414/722, 726, 421, 607, 620, 619, 621; 294/86.41, 68.23, 3, 104, 106, 88

(56) References Cited

U.S. PATENT DOCUMENTS 4,177,000 A * 12/1979 Weinert et al. ..... 414/911 X
4,227,850 A * 10/1980 Farmer et al. ..... 414/911 X
4,516,905 A * 5/1985 Cavin et al. ..... 414/620
5,073,080 A * 12/1991 Blum ..... 414/23 X
5,141,387 A * 8/1992 Smith ..... 414/23 X
5,730,576 A * 3/1998 O'Daniel ..... 414/620 X
5,938,399 A * 8/1999 Knutson ..... 414/722

* cited by examiner

*Primary Examiner*—Donald W. Underwood
(74) *Attorney, Agent, or Firm*—Curtis Harr

(57) ABSTRACT

A frame apparatus that fits on the loader arms of a skid steer front loader. This frame apparatus serves as a platform upon which a plurality of hydraulically driven tools can be employed to grasp, lift, rotate, and transport heavy objects such as oil drums and telephone poles. The hydraulically driven tools are designed in a manner that allows them to be easily installed on, and removed from, the frame apparatus by one person. This is accomplished by having a frame member as part of the tool that slides over the end of the attached frame apparatus and is held in place by passing a pin through both of the attached frame members.

19 Claims, 5 Drawing Sheets

FIG 2
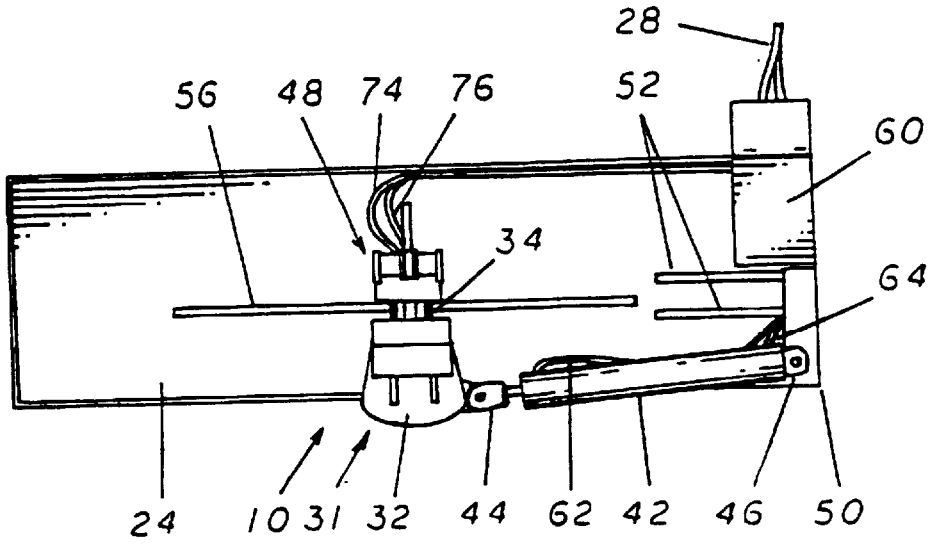
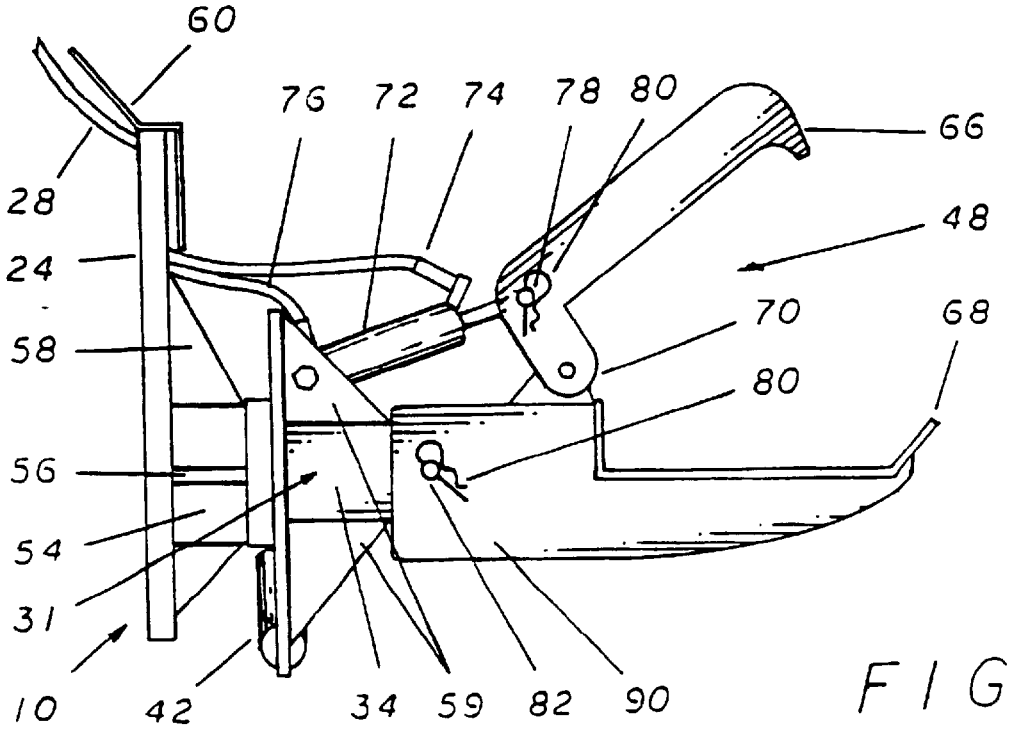
FIG 3

FIG 4
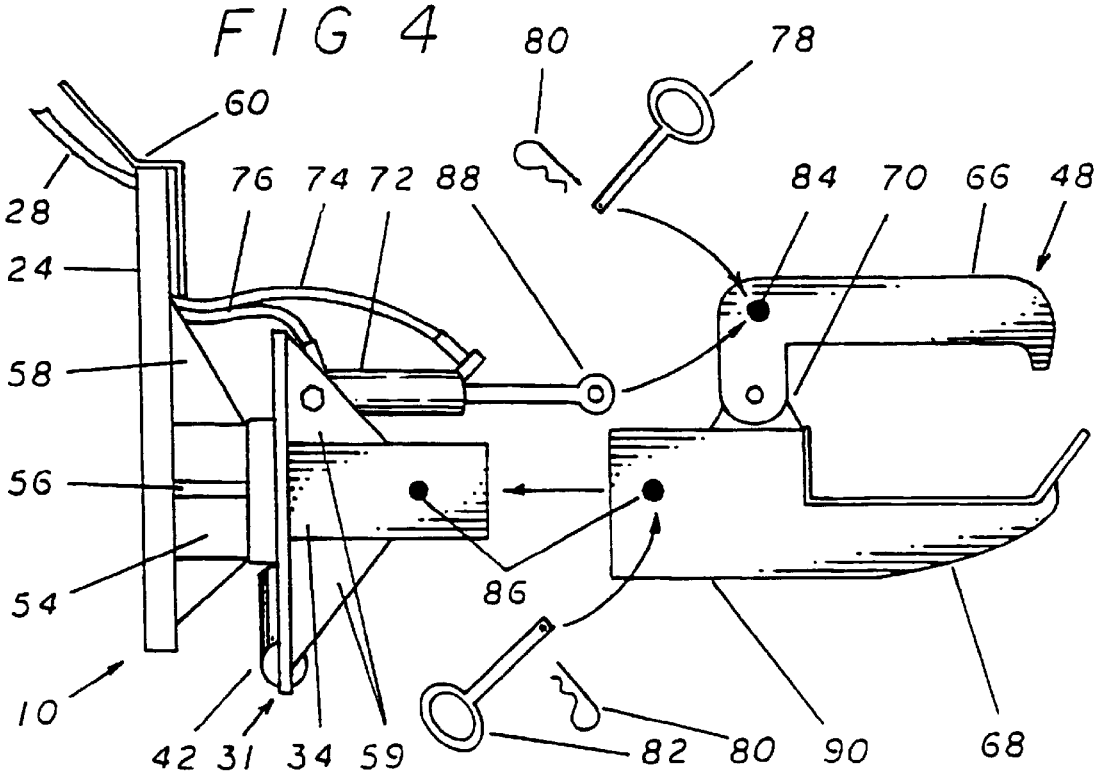
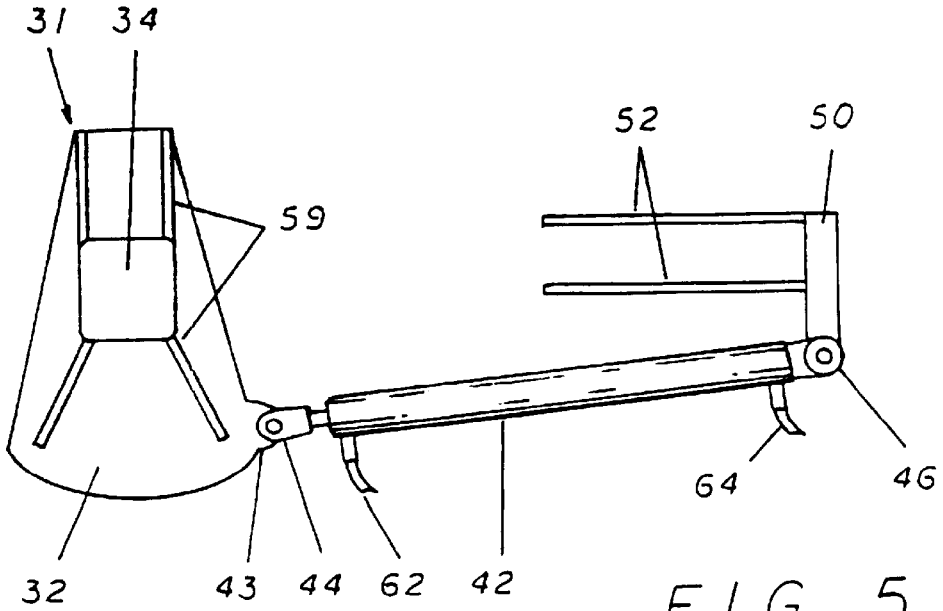
FIG 5

FIG 6
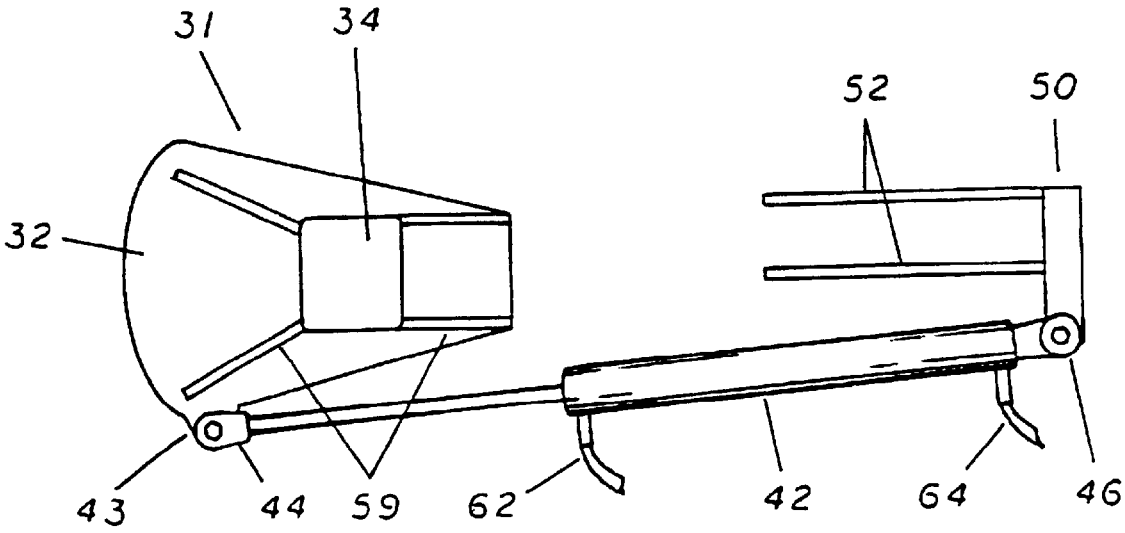
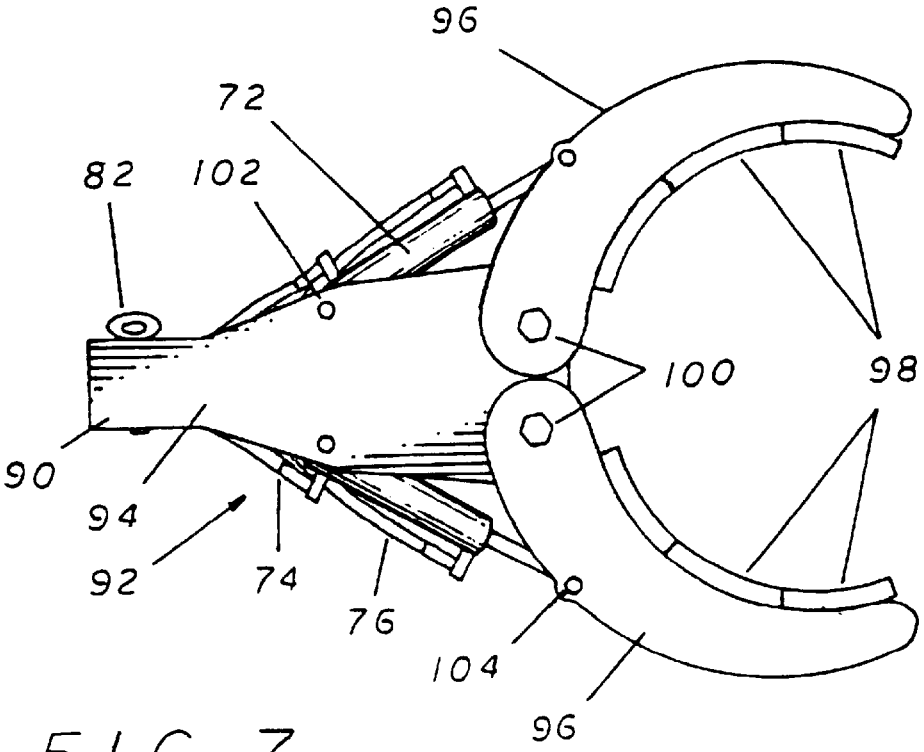
FIG 7

FIG 8
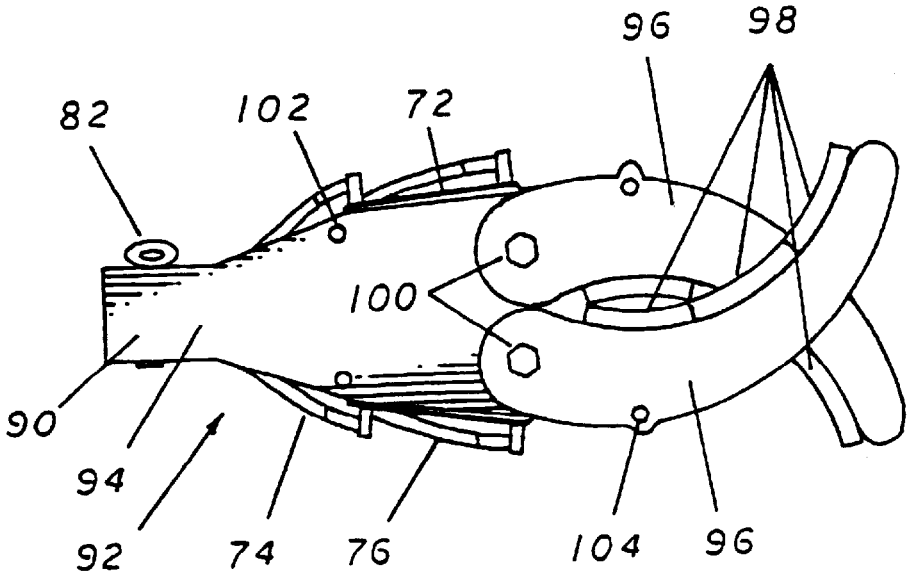
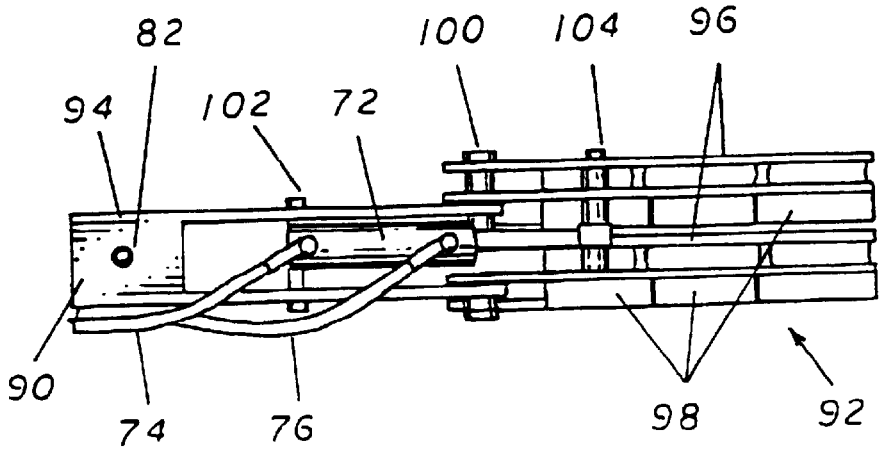
FIG 9

MULTI-PURPOSE FRONT LOADER ATTACHMENT

This application is a continuation in part of application Ser. No. 09/039,751, filed Mar. 16, 1998 now abandoned, and claims the priority of this application.

BACKGROUND OF THE INVENTION

The present invention relates to a front end loader attachment for utility tractors, and more specifically, to a front end loader attachment having multi-purpose tools for use on skid steer loaders or other similar vehicles.

Often times, industries such as factory yards, building sites, and farms utilize skid steer loaders. Skid steer loaders are small vehicles, typically having four wheels, which steer the vehicle by varying the speed of each individual wheel. Due to the unique steering method, skid steers are easily maneuverable in tight quarters. Thus, skid steer loaders have proven to be very efficient and necessary in many work situations having limited space.

As skid steers have increased in popularity, manufacturers have found it profitable to make large numbers of attachments for the front of skid steer loaders. These attachments include: snow blowers, sandbagging devices, log moving equipment, buckets, hole drilling equipment, and the like. The various attachments are limited only by the ability of the skid steers and the user's needs.

A prime example of the use of skid steers is in the farm yard. A farmer may typically need to move large barrels of chemicals, oil, and fuel from location to location. These needs may also include finding an easy way to tip the barrel to empty its contents. Farmers may also use an attachment for moving logs, telephone poles and large fence posts. It may be necessary in this situation to have some type of attachment that will articulate so a pole may be picked up if laying on its side, moved to proper location and rotated so that it may be placed, for example in a fence post hole or a telephone pole hole.

Though skid steer loaders have the convenience of attachment devices, users have encountered difficulties when utilizing several front end loader attachments at a job site. Some of these problems include: down time between connecting a new tool, connecting the hydraulics and control lines to the skid steer, and familiarizing the driver of the skid steer with the new controls of each different device. Users at a given location often may need several attachments to complete a given job.

In the past, a user would need to buy all of the attachments individually. The attachments are costly and each attachment may have redundant parts located on existing attachments, such as hydraulic cylinders, control lines and an attachment means for connecting to the skid steer loader. Often times, a user may spend a large sum of money on parts he may not need.

From this discussion, it can be seen that it would be desirable to provide a structure for skid steer loaders. This structure would need to readily attach to the skid steer loader, have a power means such as hydraulic cylinders and control lines that could be reused from attachment to attachment, and have a means of easily, quickly and inexpensively attaching various implements to the attachment means. Further, it may be desirable to provide such an attachment that provides many directions of movement for the attachment, including the ability to rotate. This problem has been solved by supplying a universal attachment mechanism for skid steers, having a hydraulically controlled cylinder, which may attach to the skid steer at an attachment point to which various tools may be affixed. Further, this attachment point is supplied with a control cylinder which allows the attachment point to rotate. Thus, the attachment point is able to minimize the expense while maximizing the number of tools a given user may have.

SUMMARY OF THE INVENTION

It is the primary objective of the present invention to provide a means of pivotally mounting a plurality of tools to the forward end of a front end loader to be used in a number of applications that would allow a single person to handle and move heavy or bulky objects that would normally require the assistance of two or more persons.

It is an additional objective of the present invention to provide such a means that is configured in a manner that would allow a single individual to easily change and secure the tools to the front end loader, thus, allowing him to accomplish a number of tasks without the aid of other people.

It is a further objective of the present invention to provide such a means that will allow an individual operator to not only manipulate an object in a vertical manner but also to change its orientation by rotating it around the central axis of the attachment.

It is a still further objective of the present invention to provide such a means of enabling an individual to manipulate heavy objects that is not only effective, but also inexpensive to own and operate.

These objectives are accomplished by the use of a frame apparatus that fits on the loader arms of a skid steer tractor. The frame apparatus serves as a platform upon which a plurality of hydraulically driven tools can be employed to grasp, lift and transport heavy objects such as oil drums and telephone poles. The hydraulically driven tools are designed in a manner that allows them to be easily installed on, and removed from, the frame apparatus by one person. This is accomplished by having a frame member as part of the tool that slides over the end of the attached frame apparatus and is held in place by passing a pin through both of the attached frame members. This design enables a single person to lift and move objects that would normally require two or more persons to accomplish.

Additionally, the present invention employs a pivotal mounting system in the attachment of the tools to the front end of the skid steer loader. This configuration allows the operator of the loader to not only pick up and transport large and heavy objects, but also to manipulate them rotationally around the central axis of the invention. The design of this feature is especially useful in working with objects such as telephone poles as it allows the operator to pick up a pole that is oriented in the horizontal plane and rotate to the vertical plane. Once the pole has rotated into position, it can then be placed into position vertically within a hole that has been dug specifically for that purpose. Additionally, the rotational ability of the present invention also enhances the flexibility of the plurality of tools that can be attached to the front end of a skid steer loader.

The rotation of the pivotal attachment plate component of the present invention is accomplished through the use of the pivot hydraulic cylinder. The pivot hydraulic cylinder is attached at its inner end to the lower inside edge of the pivot plate and at its outer end to the attachment bracket located at the outside edge of the attachment plate. This hydraulic cylinder is controlled by the skid steer operator through the skid steer's hydraulic system and the pressure and return hydraulic lines that are connected to it. By activating the cylinder it expands and forces the bottom of the pivot plate to rotate. This rotation of the pivot plate forces the central beam to also rotate which in turn imparts this rotational force to any of the tools attached to the present invention. Conversely, the retraction of the pivot hydraulic cylinder brings the pivot plate and any tool connected to it back to its original upright position.

The individual tools attached to the present invention are driven by a hydraulic cylinder which is mounted to the upper surface of the central beam and is also supplied with hydraulic pressure from the skid steer's system. The hydraulic cylinder is used generally to articulate the upper member of the attached tool. Thus, for example the skid steer operator controls the the hydraulic cylinder which in turn articulates the components of the attachment which allows the operator to accomplish the desired job.

For a better understanding of the present invention, reference should be made to the drawings and the description in which there are illustrated and described preferred embodiments of the present invention.

DESCRIPTION OF THE DRAWINGS

FIG. 2 is a front elevation view of the present invention showing it as configured with the grasping claw apparatus and illustrating the orientation of its major components in relation to the mounting plate.

FIG. 3 is a side elevation view of the present invention showing it as configured with the grasping claw apparatus and illustrating the manner of construction of the invention and the grasping claw apparatus.

FIG. 4 is a side elevation view of the present invention illustrating the manner in which a tool, in this case the grasping claw apparatus, is both fitted to and operated by the present invention.

FIG. 5 is a front elevation view of the major components of the present invention and illustrates the position of the pivot plate and pivot hydraulic cylinder when the invention is in the normal position.

FIG. 6 is a front elevation view of the major components of the present invention and illustrates the position of the pivot plate and pivot hydraulic cylinder when the invention is in the rotated position.

FIG. 7 is a side elevation view of the tree claw apparatus, an additional attachment tool that may be used with the present invention, illustrating the manner of construction when the tree claw is in the open position.

FIG. 8 is a side elevation view of the tree claw apparatus, illustrating the manner of construction when the tree claw is in the closed position, allowing for grasping and holding.

FIG. 9 is a top view of the tree claw apparatus, illustrating the manner of construction of the components of the attachment articulation hydraulic cylinder with the tree claw arms.

DESCRIPTION OF THE PREFERRED EMBODIMENT

Figure 1:
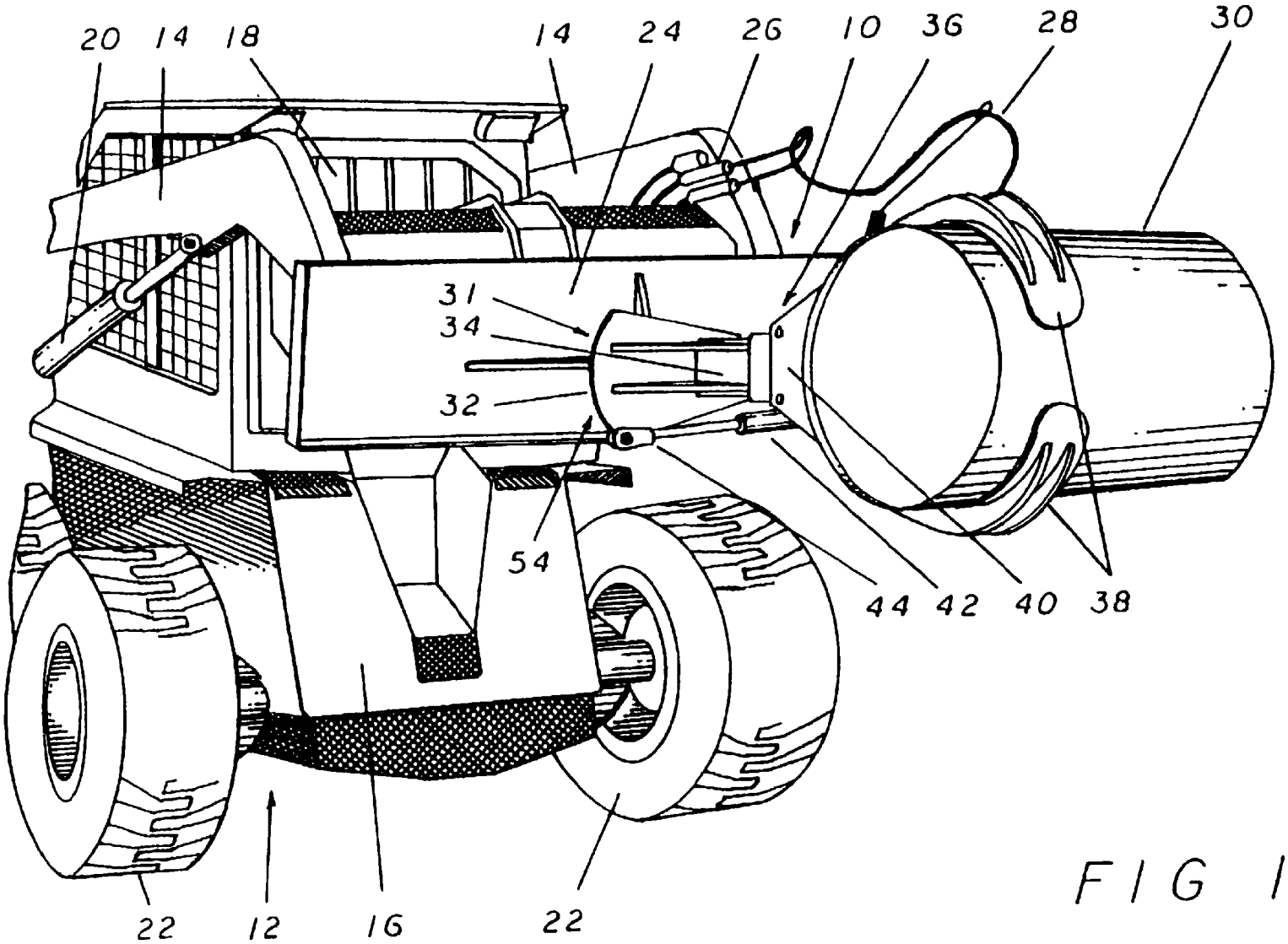
FIG. 1 is a perspective view of a typical skid steer loader being shown as equipped with the present invention which is configured with the barrel handler apparatus attached to the arms of the skid steer loader.

Referring now to the drawings, and more specifically to FIG. 1, the pivoting skid steer loader attachment 10 is an accessory item intended to be used in conjunction with front end skid steer loaders 12. Front end skid steer loaders 12 are typically highly maneuverable motor driven vehicle used to pick up and transfer raw materials having skid steer wheels 22 and loader arms 14 which are driven and controlled through the use of the loader arm hydraulic cylinders 20. The front end skid steer loaders 12 also generally consist of a loader body 16 to which all of its components are attached and which also contains the loader cab 18 within which the operator sits during the use of the present invention.

The pivoting skid steer loader attachment 10 consists of an attachment plate 24 which is easily mounted to and dismounted from the forward most portion of the loader arms 14. The operator of the front end skid steer loader 12 can control the present invention and any of its plurality of attachments through the front end skid steer loader 12 by manipulating the loader arms 14. Thus, he can lift and carry large items, such as full oil barrels 30, with only the effort of operating the hydraulic control and steering mechanisms of the front end skid steer loader 12.

The hydraulic power needed to operate the present invention and its associated tools is supplied by the front end skid steer loader 12 through the primary hydraulic assembly 26 located st the front of one of the loader arms 14. The primary hydraulic lines 28 span the space between the front of the loader arms 14 and the attachment plate 24 and are long enough to provide enough slack to allow for the changing position of the invention during operation.

The pivot assembly mount 54 extends forward from the face of the attachment plate 24 and provides the point at which the pivot assembly 31 is attached. The pivot plate assembly 31 consists primarily of the pivot plate 32 and the central beam 34. The pivot plate 32 has attached to one of its lower corners the pivot hydraulic cylinder 42 by use of the inside cylinder attachment fitting 44 and it is the combination of these components which provide the rotational force for the operation of the invention. Additionally, the central beam 34 is the portion of the pivot assembly 31 to which one of the plurality of tools can be attached to by the skid steer loader operator to perform a desired job.

One of the tools most commonly used with the present invention is the barrel handler assembly 36 which is illustrated in FIG. 1. The barrel handler assembly 36 is primarily made up of the barrel handler arms 38 which are pivotally mounted hemispherical claw-like components and, in their closed position, having their most forward ends not quite joining to form a near circle with a forward facing gap. The pivotal attachment of the barrel handler arms 38 is accomplished at the arm mount assembly 40 at their inward end. The arm mount assembly 40 also serves to tie the barrel handler arms 38 to the forward end of the central beam 34 and, therefore, the present invention. This configuration allows the operator to open and close the barrel handler arms 38 which enables him to manipulate the barrel handler assembly 36 to grasp and lift large cylindrical objects such as oil barrels.

The orientation of an attachable tool, in this example a claw assembly 48, in relation to the attachment plate 24 and the pivot hydraulic cylinder 42 is further illustrated in FIG. 2. The pivot assembly 31 is located and mounted at the center of the attachment plate 24 which positions the claw assembly 48 in the position at which it can be most easily controlled and manipulated by the operator. The pivot plate 32 then extends downward from the central beam 34 so that its lowest edge is a relatively large distance from its point of attachment. This distance provides a greater amount of rotational leverage through the expanding and contracting action of the pivot hydraulic cylinder 42 to the claw assembly 48 (or other attached tool) while the present invention is in use. The additional leverage created by this design enables the invention to rotate and manipulate greater loads without the need to increase the amount of power that is readily available from the hydraulic system of the front end skid steer loader 12.

One of the lower corners of the pivot plate 32 is equipped with a protruding pivot tab 43 to which the inside cylinder attachment fitting 44 of the pivot hydraulic cylinder 42 is attached. From this point of attachment, the pivot hydraulic cylinder then extends outward to the edge of the attachment plate 24 where it is attached to the pivot cylinder attachment bracket by means of the outside cylinder attachment fitting 46. The pivot cylinder attachment bracket 50 is a vertical plate located at one of the lower corners of the attachment plate 24 and is braced by a pair of horizontally extending bracket braces 52 that connect and help to secure the pivot cylinder attachment bracket 50 to the attachment plate 24.

This FIG. also illustrates the manner in which hydraulic pressure is supplied to the present invention by the primary hydraulic lines 28. The primary hydraulic lines 28 enter the attachment plate 24 behind the hydraulic control valve 60 which is located at the upper corner of the attachment plate 24 that is directly above the pivot cylinder attachment bracket 50. The purpose of the hydraulic control valve 60 is to serve as switching point between the pivot hydraulic cylinder 42 and the attachment articulation hydraulic cylinder 72.

From the point of entry behind the hydraulic control valve 60, a portion of the hydraulic pressure is diverted by hydraulic control valve 60 through the pivot hydraulic cylinder 42 through the pivot cylinder hydraulic feed line 62 and the pivot cylinder hydraulic return line 64. The use of these components allows the operator to control the pivot hydraulic cylinder 42 which in turn allows him to control the rotational orientation of the claw assembly 48 or other attached tool. Additionally, a portion of the hydraulic pressure supplied by the primary hydraulic lines 28 is similarly diverted through the articulation cylinder hydraulic feed line 74 and the articulation cylinder hydraulic return line 76. This system provides for the control of individual components of the claw assembly 48 or other attached tool and will be explained in further detail below.

Additionally, the manner in which the present invention is constructed to provide the pivoting ability that is central to the purpose of the invention is further illustrated in FIGS. 5 and 6. As previously stated, the pivot assembly 31 is connected to the attachment plate 24 through the pivot hydraulic cylinder 42. The pivot hydraulic cylinder 42 is connected to the pivot tab 43 located at the lower inside corner of the pivot plate 32 by means of the inside cylinder attachment fitting 44. The opposite end of the pivot hydraulic cylinder 42 is connected to the attachment plate 24 through the pivot cylinder attachment bracket 50 by means of the outside cylinder attachment fitting 46. Additionally, these attachments are all pivotal in nature which allows the orientation of the pivot hydraulic cylinder 42 to change in relation to the other components of the invention during operation. Finally, the hydraulic pressure necessary to expand and contract the pivot hydraulic cylinder 42 is supplied though the pivot cylinder hydraulic feed and return lines, 66 and 68.

When the pivot hydraulic cylinder 42 is contracted (as illustrated in FIG. 5), the pivot plate 32 is oriented in the upright position with its wider and lower end positioned in a downward manner. This orientation transfers to any tool that is connected to the central beam 34 which means that it remains in the relative position at which it was fixed to the invention. Conversely, when the pivot hydraulic cylinder 42 is expanded (as illustrated in FIG. 6), the bottom of the pivot plate 32 is forced away from the pivot cylinder attachment bracket 50 which rotates the entire pivot assembly, and any tools attached to it, as much as one hundred twenty-seven degrees. This design allows the operator of a front end skid steer loader 12 to rotate an object in this fashion which greatly increases the flexibility of such vehicles when used for these purposes.

The manner in which tools such as the claw assembly 48 are attached to and controlled by the present invention are further illustrated in FIGS. 3 and 4. The attachment plate 24 is the component of the invention which connects it to the loader arms 14 of the front end skid steer loader 12. The attachment plate 24 not only serves as the mounting mechanism for the present invention, but also provides the base upon which the other components of the present invention are built. Extending forward from the front of the attachment plate 24 is the pivot assembly mount 54. The pivot assembly mount 54 is structurally braced in its initial portion by the horizontal mount brace 56 and the vertical mount brace 58. These braces consists of four right triangles that are permanently attached to all four of the outer surfaces of the pivot assembly mount 54 on one side and to the front surface of the attachment plate 24 on the other. This configuration provides a more than adequate amount of structural integrity for the mounting of the pivot plate assembly 31 on its outer most surface.

The configuration of the pivot assembly mount 54 fixedly attaches it to the face of the attachment plate 24 which means that the rotational nature of the present invention come from the manner in which the pivot assembly 31 is mounted to the pivot plate mount 54. Appropriately, the mounting of the pivot assembly 31 to the pivot assembly mount 54 is accomplished in such a manner that allows the pivot assembly 31 to rotate freely around the central axis of the pivot assembly mount 54 and the central beam 34. Again, this rotational ability is controlled and limited by attachment of the pivot hydraulic cylinder 42 on the lower edge of the pivot plate 32.

The end of the central beam 34 also provides the attachment point for the plurality of tools that can be used in conjunction with the present invention. This attachment is accomplished by using an attachment sleeve 90, as illustrated by the rearward portion of the claw assembly 48, which is slightly larger in its inside diameter than the outside diameter of the forward portion of the central beam 34. Therefore, the attachment of the claw assembly 48 to the central beam 34 is accomplished by the user sliding the larger attachment sleeve 90 over the forward portion of the central beam 34. Once this has been accomplished, the claw assembly is fixed in position by the inserting attachment retainer pin 82, which is a large handled metal pin, through the attachment retainer pin holes 86 located in corresponding locations on the forward portion of the central beam 34 and the attachment sleeve 90. Once the attachment retainer pin 82 has passed completely through these components, it is secured in place by the use of a retainer clip 80 which prevents attachment retainer pin 82 from slipping back through the attachment retainer pin holes 86. This design provides for the secure attachment of a plurality of hydraulically articulated tools, such as the claw assembly 48, to the central beam 34 of the present invention.

Additionally, the space between the pivot assembly 31 and the attached tool, in this case the claw assembly 48, provides the point of attachment for the attachment articulation hydraulic cylinder 72. The attachment articulation hydraulic cylinder 72 is the component of the invention which is used to control the positioning of individual components of the attached tool. The attached articulation hydraulic cylinder 72 is pivotally attached to one of the central beam braces 59 (which provide structural integrity to the pivot assembly 31) from where it extends diagonally forward and upward to terminate at the cylinder pin receptor 88. The cylinder pin receptor 88 is the device by which the attachment articulation hydraulic cylinder 72 is connected to the upper jaw 66 of the claw assembly 48. This connection is possible as the cylinder pin receptor 88 is equipped with a hole that can be positioned to correspond in location to the upper claw retainer pin hole 84 which is located at the rearward portion of the upper claw 66. Once this positioning has been accomplished, the two components are held together by passing the upper claw retainer pin 78 through these aligned holes in much the same fashion as described for the attachment retainer pin 82 above where it is again held in place by the use of a retainer clip 80.

The design of the claw assembly 48 in conjunction with the attachment articulation hydraulic cylinder 72 allows the upper claw 66 to open and close in relation to the lower claw 68. The pivoting ability of the upper claw 66 in relation to the lower claw 68 is facilitated by the use of the claw pivot mount 70 which is used to attach the upper and lower claws, 66 and 68, and allows the upper claw 66 to freely pivot around this point of attachment when the attachment articulation hydraulic cylinder 72 is activated by the operator.

The opening and closing action of the claw assembly 48 is controlled by the attachment articulating hydraulic cylinder 72 which is controlled in turn through the articulation cylinder hydraulic feed and return lines, 74 and 76. As the attachment articulation hydraulic cylinder 72 is contracted, its connection to the rear portion of the upper claw 66 pulls it back around the claw pivot mount 70 which in turn opens the space between the forward portions of the upper and lower claws, 66 and 68. This opening allows the operator to slip the claw assembly 48 over objects such as poles and the like whereupon the operator reverses the process by expanding the attachment articulation hydraulic cylinder 72 which forces the upper and lower claws, 66 and 68, together and firmly grasps any object in between. With this accomplished, the operator can then manipulate the object into the position which is necessary to complete the job at hand with little physical effort.

An additional attachable tool that can be used in conjunction with the present invention and a front end skid steer loader 12 is illustrated in FIGS. 7, 8, and 9. This tool is referred to as a tree claw 92 and is most commonly employed to grasp the trunk portion of a tree to move it around during landscaping operations. The tree claw 92 is fitted to the forward portion of a front end skid steer loader 12 through the attachment plate 24 in much the same manner as described above with the other tools.

The tree claw 92 is primarily made up of the central claw body 94 and the two claw arms 96 that are pivotally attached to it forward edge. The claw body 94 is the portion of the tree claw 92 that attaches to the other components of the present invention. This attachment is accomplished by the use of an attachment sleeve 90 which is generally the most rearward portion of the claw body 94 and is held in the proper location by the use of the attachment retainer pin 82 which passes through the attachment sleeve from one side to the other. With this accomplished, the tree claw 92 is securely held in place on the present invention.

The inner edges of the claw arms 96 are lined with relatively thick plates made of a hard rubber or other similar material and are called the tree protection bumpers 98. The purpose of these tree protection bumpers 98 is too keep the claw arms from digging too far into the bark of a tree while it is being transported by the use of the present invention. This is an important feature of the tree claw 92 tool because if the bark of a tree is damaged too severely during handling it will cause the tree to die. This potential result occurs because the water and other nutrients needed by the tree to live are gathered by the root system and are transported to the remainders of the tree by a thin layer of cells located just beneath the interior surface of the bark. If this layer is damaged or destroyed the flow of water and nutrients will be cut off and the tree will then wither and die.

The pivotal mounting of the claw arms 96 to the claw body 94 is accomplished by the use of the arm pivot mount bolts 100 which pass through both the width of the claw arms 86 and the forward end of the claw body 94. This method of attachment allows the claws arms 96 to pivot around their mounting which allows them to be manipulated through hydraulic articulation. Additionally, the two claw arms 96 are designed in such a way that when their forward tips are forced to close by the hydraulic articulation, they can function much like a pair of common house scissors in that their tips can slide past one another in relation to the center longitudinal plane. This aspect of the design of the claw arms 96 is clearly illustrated in FIG. 8 and is important to the tree grasping function of the claw arms 96 as it allows the tree claw 92 to grab and effectively hold onto trees that are of relatively small diameters.

The opening and closing of the claw arms 96 is controlled by the use of attachment articulation hydraulic cylinders 72 which are supplied with hydraulic pressure by the articulation cylinder hydraulic feed and return lines, 74 and 76, in much the same manner as previously described. The difference in the illustrated example is that there are two such attachment articulation hydraulic cylinders 72 used but the principles involved are the same as when a single unit is used. The attachment articulation hydraulic cylinders 72 are attached at their rearward end to the claw body 94 by the use of the rear cylinder mount pin 102 and at its forward end to the claw arms 96 by the front cylinder mount pin 104. Additionally, these mountings are all pivotal in nature which allow the attachment articulation hydraulic cylinders 72 to change their orientation during claw arm 96 articulation. These design features of the tree claw 92 allow a user to easily pick up and move trees of varying sizes around a work site without damaging the delicate inner bark of the tree.

Although the present invention has been described in considerable detail with reference to certain preferred versions thereof, other versions are possible. For example, the type of tractor used may vary greatly. Therefore, the spirit and scope of the appended claims should not be limited to the description of the preferred versions contained herein.

What is claimed is:

1. A multi-purpose front loader attachment for use on a skid steer loader tractor having a hydraulic pumping means, said skid steer loader tractor further having a pair of loader arms, each having a first and a second end with said first end being connected to said utility tractor and said second end being capable of receiving various attachments, said multi-purpose front end loader attachment comprises:

an attachment plate having a front surface and a rear surface, said rear surface being removably attachable to said second ends of said loader arms;

a pivot assembly mount fixedly attached to the front surface of said attachment plate;

a central beam having a first end, a second end and top surface, said central beam rotatably attached in a perpendicular arrangement at said first end to said pivot assembly such that said central beam can rotate about an axis substantially perpendicular to said attachment plate;

a pivot hydraulic cylinder having a first and second end with said first end pivotally attached to said central beam and said second end pivotally attached to said attachment plate such that the expansion and contraction of said pivot cylinder causes said central beam to rotate about said axis, and a connection means from said hydraulic cylinder to said hydraulic pumping means; and an articulation hydraulic cylinder having a first and second end with said first end being pivotally attached to said central beam and a connection to said hydraulic pumping means.

2. A multi-purpose front loader attachment as in claim 1 further comprising a pivot plate on said first end of said central beam.

3. A multi-purpose front loader attachment as in claim 2 wherein said first end of said pivot hydraulic cylinder is pivotally attached to said central beam through said pivot plate.

4. A multi-purpose front loader attachment as in claim 3 further comprising an attachment means at said second end of said central beam for receiving tools.

5. A multi-purpose front loader attachment as in claim 4 wherein said articulation hydraulic cylinder is removably attached to said central beam.

6. A multi-purpose front loader attachment as in claim 5 further comprising a central beam brace section extending outward from said pivot plate and along said central beam so as to support said central beam.

7. A multi-purpose front loader attachment as in claim 4 further comprising a barrel handler assembly having a barrel handler frame for attachment to said second end of said central beam attachment means, and a pair of hemispherical barrel handler arms mounted to the end of said barrel handler frame.

8. A multi-purpose front loader attachment as in claim 6 further comprising a claw assembly having a claw frame beam for attachment to said second end of said central beam attachment means, an upper and lower elongate claw mounted to the end of said claw frame beam and a connection means between said upper claw and second end of said articulation hydraulic cylinder.

9. A multi-purpose front loader attachment as in claim 4 further comprising a tree handling assembly having a tree handling frame for attachment to said second end of said central beam attachment means, a pair of hemispherical handling arms mounted to the end of said tree handling frame and a drive system for said handling arms.

10. A multi-purpose front end loader attachment for use on a utility tractor having a power drive system and a hydraulic pumping means said utility tractor further having a jointed and pivotally mounted pair of loader arms, each having a first and a second end with said first end being connected to said utility tractor and said second end being capable of receiving various attachments, said multi-purpose front end loader attachment comprises:

an attachment plate having a front surface and a rear surface, said rear surface being removably attachable to said second ends of said loader arms;

a pivot assembly mount fixedly attached to the front surface of said attachment plate;

a central beam having a first end, a second end and top surface, said central beam being pivotally attached in a perpendicular arrangement at said first end to said pivot assembly such that said central beam can rotate about an axis substantially perpendicular to said attachment plate and substantially centered on said attachment plate said central beam further being adapted to receive various tools;

a central beam brace section extending outward from said pivot plate and along said central beam so as to support said central beam said central beam brace section further defining an articulation cylinder mounting point;

a pivot cylinder attachment frame fixedly mounted to said front surface of said attachment plate; and a hydraulic pivot cylinder having a first and second end with said first end pivotally attached to said central beam and said second end pivotally attached to said pivot cylinder attachment frame such that the expansion and contraction of said pivot cylinder causes said central beam to rotate about said axis.

11. A multi-purpose front loader attachment as in claim 10 further comprising a pivot plate on said first end of said central beam wherein said first end of said pivot hydraulic cylinder is pivotally attached to said central beam through said pivot plate.

12. A multi-purpose front end loader attachment as in claim 11 further comprising an attachment means at said second end of said central beam for receiving tools.

13. A multi-purpose front end loader attachment as in claim 12 further comprising a barrel handler assembly having a barrel handler frame for attachment to said second end of said central beam attachment means, a pair of hemispherical barrel handler arms mounted to the end of said barrel handler frame.

14. A multi-purpose front end loader attachment as in claim 12 further comprising a claw assembly having a claw frame beam for attachment to said second end of said central beam attachment means, an upper and lower elongate claw mounted to the end of said claw frame beam.

15. A multi-purpose front loader attachment as in claim 12 further comprising a tree handling assembly having a tree handling frame for attachment to said second end of said central beam attachment means, a pair of hemispherical handling arms mounted to the end of said tree handling frame and a drive system for said handling arms.

16. A skid steer loader with a multi-purpose front loader attachment comprising:

a wheeled skid steer tractor;

a power drive system for said tractor;

a hydraulic pumping means connected to said power drive system;

a pair of jointed and pivotally mounted loader arms, each having a first and a second end with said first end being connected to said skid steer tractor and said second end being capable of receiving various attachments;

an attachment plate having a front surface and a rear surface, said rear surface being removably attachable to said second ends of said wheeled skid steer tractor loader arms;

a pivot assembly mount fixedly attached to the front surface of said attachment plate;

a central beam having a first end, a second end and top surface, said central beam being pivotally attached in a perpendicular arrangement at said first end to said pivot assembly such that said central beam can rotate about an axis substantially perpendicular to said attachment plate and substantially centered on said attachment plate said central beam further being adapted to receive various tools;

a central beam brace section extending outward from said pivot plate and along said central beam so as to support said central beam said central beam brace section further defining an articulation cylinder mounting point;

a pivot cylinder attachment frame fixedly mounted to said front surface of said attachment plate; and a hydraulic pivot cylinder having a first and second end with said first end pivotally attached to said central beam and said second end pivotally attached to said pivot cylinder attachment frame such that the expansion and contraction of said pivot cylinder causes said central beam to rotate about said axis.

17. A skid steer loader with a multi-purpose front loader attachment as in claim 16 further comprising a barrel handler assembly having a barrel handler frame for attachment to said second end of said central beam attachment means, and a pair of hemispherical barrel handler arms mounted to the end of said barrel handler frame.

18. A skid steer loader with a multi-purpose front loader attachment as in claim 16 further comprising a claw assembly having a claw frame beam for attachment to said second end of said central beam attachment means, an upper and lower elongate claw mounted to the end of said claw frame beam and a hydraulic connection means between said upper claw and said central beam.

19. A skid steer loader with a multi-purpose front loader attachment as in claim 16 further comprising a tree handling assembly having a tree handling frame for attachment to said second end of said central beam attachment means, a pair of hemispherical handling arms mounted to the end of said tree handling frame and a drive system for said handling arms.

* * * * *